US009822481B2

(12) United States Patent
Pourdeyhimi et al.

(10) Patent No.: US 9,822,481 B2
(45) Date of Patent: Nov. 21, 2017

(54) METHODS OF FORMING AN ARTIFICIAL LEATHER SUBSTRATE FROM LEATHER WASTE AND PRODUCTS THEREFROM

(71) Applicant: NORTH CAROLINA STATE UNIVERSITY, Raleigh, NC (US)

(72) Inventors: Behnam Pourdeyhimi, Cary, NC (US); Angelo Corino, Garner, NC (US); John Fry, Willow Spring, NC (US); Alvin Fortner, Raleigh, NC (US); Ben Lambert, Mount Olive, NC (US)

(73) Assignee: North Carolina State University, Raleigh, NC (US)

( * ) Notice: Subject to any disclaimer, the term of this patent is extended or adjusted under 35 U.S.C. 154(b) by 204 days.

(21) Appl. No.: 14/646,222

(22) PCT Filed: Dec. 17, 2013

(86) PCT No.: PCT/US2013/075619

§ 371 (c)(1),
(2) Date: May 20, 2015

(87) PCT Pub. No.: WO2014/099884

PCT Pub. Date: Jun. 26, 2014

(65) Prior Publication Data

US 2015/0292148 A1 Oct. 15, 2015

Related U.S. Application Data

(60) Provisional application No. 61/738,461, filed on Dec. 18, 2012.

(51) Int. Cl.
*D01G 25/00* (2006.01)
*D06N 3/00* (2006.01)
(Continued)

(52) U.S. Cl.
CPC ..... *D06N 3/0011* (2013.01); *D04H 1/40* (2013.01); *D04H 1/4266* (2013.01);
(Continued)

(58) Field of Classification Search
CPC ..... D01G 25/00; D01H 1/70; D01H 1/74
(Continued)

(56) References Cited

U.S. PATENT DOCUMENTS 3,607,609 A * 9/1971 Bogdanovicz ..... D04H 1/00 156/62.2
3,860,472 A 1/1975 Derville
(Continued)

FOREIGN PATENT DOCUMENTS

EP 1466044 B1 3/2006
SU 41497 A1 2/1935
(Continued)

OTHER PUBLICATIONS

International Search Report and Written Opinion dated Jun. 10, 2014 from PCT International Application No. PCT/US2013/075619.

(Continued)

*Primary Examiner* — Jeff Aftergut
(74) *Attorney, Agent, or Firm* — Womble Carlyle Sandridge & Rice LLP

(57) ABSTRACT

Methods of making an artificial leather substrate from leather waste (e.g., shavings, such as wet blue, and/or pulverized trim scrap) and products formed using the artificial leather substrate are disclosed. In one example, the artificial leather substrate comprises a composite web comprising leather waste mixed with a lightweight web, a lightweight web atop the composite web, and another lightweight web atop the first lightweight web. A method of making the artificial leather substrate includes the steps of
(Continued)

mixing one or more fiber components, leather shavings, and/or pulverized leather trim scrap to form the composite web; needle punching the composite web; and bonding the composite web.

16 Claims, 6 Drawing Sheets

(51) Int. Cl.

| | |
|---|---|
| ***D06M 17/00*** | (2006.01) |
| ***D04H 1/4266*** | (2012.01) |
| ***D04H 1/46*** | (2012.01) |
| ***D04H 1/492*** | (2012.01) |
| ***D04H 1/542*** | (2012.01) |
| ***D04H 1/593*** | (2012.01) |
| ***D04H 1/732*** | (2012.01) |
| ***D06B 1/00*** | (2006.01) |
| ***D06C 15/00*** | (2006.01) |
| ***D04H 1/40*** | (2012.01) |
| ***D04H 1/4274*** | (2012.01) |
| ***D04H 1/488*** | (2012.01) |

(52) U.S. Cl.
CPC ..... *D04H 1/4274* (2013.01); *D04H 1/46* (2013.01); *D04H 1/488* (2013.01); *D04H 1/492* (2013.01); *D04H 1/542* (2013.01); *D04H 1/593* (2013.01); *D04H 1/732* (2013.01); *D06B 1/00* (2013.01); *D06C 15/00* (2013.01); *D06M 17/00* (2013.01); *D06N 3/00* (2013.01); *D06N 3/0086* (2013.01)

(58) Field of Classification Search
USPC ..... 156/148, 62.2–62.8, 181, 94
See application file for complete search history.

(56) References Cited

U.S. PATENT DOCUMENTS

| | | | | |
|---|---|---|---|---|
| 6,264,879 | B1 | 7/2001 | Addie | |
| 7,438,777 | B2 | 10/2008 | Pourdeyhimi et al. | |
| 7,467,446 | B2 | 12/2008 | Pourdeyhimi et al. | |
| 7,731,814 | B2 | 6/2010 | Bevan | |
| 7,935,645 | B2 | 5/2011 | Pourdeyhimi et al. | |
| 7,981,226 | B2 | 7/2011 | Pourdeyhimi et al. | |
| 7,981,336 | B2 | 7/2011 | Pourdeyhimi et al. | |
| 8,225,469 | B2 | 7/2012 | Bevan | |
| 2006/0194486 | A1* | 8/2006 | Wilka ..... | A43B 23/085 442/5 |
| 2011/0318986 | A1 | 12/2011 | Pourdeyhimi et al. | |

FOREIGN PATENT DOCUMENTS

| | | | |
|---|---|---|---|
| SU | 417563 | A | 10/1974 |
| SU | 887651 | A | 12/1981 |
| SU | 1707109 | A1 | 1/1992 |
| WO | 2009029391 | A2 | 3/2009 |

OTHER PUBLICATIONS

International Preliminary Report on Patentability dated Jun. 23, 2015 from PCT International Application No. PCT/US2013/075619.

N. Fedorova and B. Pourdeyhimi, "High Strength, Light Weight Nonwovens via Spunbonding," J. Appl. Polym. Sci., 104(5):3434-3442 (2007).

Durany et al. "High Surface Area Nonwovens via Fibrillating Spunbonded Nonwovens Comprising Islands-In-The Sea Bicomponent Filaments: Structure-Process-Property Relationships," J. Mat. Sci., 44(21): 5926-5934 (2009).

* cited by examiner

METHODS OF FORMING AN ARTIFICIAL LEATHER SUBSTRATE FROM LEATHER WASTE AND PRODUCTS THEREFROM

CROSS REFERENCE TO RELATED APPLICATIONS

This patent application is a 35 U.S.C. §371 U.S. national phase entry of PCT International Application PCT/US2013/075619 having an international filing date of Dec. 17, 2013, which claims the benefit of U.S. Provisional Application Ser. No. 61/738,461, entitled "Methods of Forming an Artificial Leather Substrate from Leather Waste and Products Therefrom," filed Dec. 18, 2012, the contents of each of the aforementioned applications is herein incorporated by reference in their entirety.

TECHNICAL FIELD

The presently disclosed subject matter relates generally to artificial leather products and processes, and more particularly to methods of making an artificial leather substrate from leather waste and products formed using the artificial leather substrate.

BACKGROUND

Leather tanning is a process for treating skins of animals to produce leather, a material that is more durable and less susceptible to decomposition. Conventional processes for producing tanned leather and tanned leather goods generate considerable waste material. One of the waste byproducts of the leather tanning process is the clippings or shavings from the surface of the leather that resemble pulp. This waste material is known as "wet blue" because of its color after tanning with a chromium compound. Wet blue is typically disposed of in landfill. Another waste material is pulverized trim scrap, which is a material that is fully colored and finished from the leather die cutting operation.

Wet blue shavings from the tanning process, scraps from cut leather, and other leather waste from conventional leather processes are usually bulked and transported to landfills. Disposal of leather waste in this way is environmentally undesirable, impacts livestock, can result in air pollution and fouling of wastewater, and can be costly to the leather producer. Accordingly, sustainable methods of using the waste from the leather tanning and production processes are desirable.

DEFINITIONS

As used herein, an "airlay process" includes taking the fibers through a mechanical opening, then using a large volume of air to transport the fibers to a forming head, which deposits a uniform layer of the fiber onto a moving conveyer belt. Such fibers can then be pressed to a desired thickness using a machine, such as a double belt press. Exemplary airlaying processes known in the art are disclosed in Laursen et al., U.S. Pat. No. 4,640,810, entitled "System for producing an air laid web," issued on Feb. 3, 1987; and Soerensen, U.S. Pat. No. 5,527,171, entitled "Apparatus for depositing fibers," issued on Jun. 18, 1996; each of which is incorporated herein by reference in their entirety. In the airlaying process, generally, a mat of fibers is fed down a chute into an airlaying apparatus that entrains the fibers into an airstream. Loose fibers fall from the airstream and are collected as a fibrous web material on a forming surface.

As used herein, the term "artificial leather" includes a fabric or finish intended to be substituted for natural leather in applications including, but not limited, to, upholstery, including automobile upholstery, clothing, and fabrics, and other uses where a leather-like finish is required, but the use of natural leather is cost-prohibitive, unsuitable, or unusable for ethical reasons.

"Calendering" is a process in which the substrate is passed under rollers, sometimes under conditions of high temperatures and/or pressures. Calendering consolidates the web and leather waste products and makes the substrate denser. Accordingly, as used herein, the terms "calender," "calendering," and grammatical derivatives thereof, generally refer to a process in which a fabric or nonwoven web is passed through two or more heavy rollers, which can be heated, under pressure. This mechanical finishing process can be used to impart surface effects, including, but not limited to, high luster, glazing, moiré, and embossing, onto fabrics or nonwoven webs. As used herein, "embossed" refers to a material that is carved into or decorated with a raised design. Accordingly, in certain embodiments, the heated calender roll can be patterned in some way so that the entire fabric is not bonded across the entire surface resulting in, for example, an aesthetically pleasing fabric.

As used herein, the terms "crosslap," "crosslapping," "crosslapped," and grammatical derivations thereof, mean to spread a loose fiber, for example a filament or yarn, in a back and forth direction that is roughly transverse to the direction of the web on which the fiber is laid with the individual laps partially overlapping each other such that they form an acute angle with each other.

As used herein, a "chute-feed system" generally refers to a pneumatic fiber transport system that is used in linking textile processing equipment or operations, such as opening, blending, and carding.

As used herein, the term "denier" refers to a unit of measure for the linear mass density of fibers. More particularly, a "denier" is defined as the mass in grams per 9,000 meters.

"Hydroentangling" is a process by which a substrate is formed by mechanically wrapping and knotting fibers in a web through the use of high-velocity jets or curtains of water. Accordingly, as used herein, the terms "hydroentangle" or "hydroentangling" refers to a process by which a high velocity water jet or, in some embodiments, an air jet is forced through a web of fibers causing them to become randomly entangled. Hydroentanglement also can be used to impart images, patterns, or other surface effects to a nonwoven fabric by, for example, hydroentangling the fibers on a three-dimensional image transfer device, such as that disclosed in Bassett et al., U.S. Pat. No. 5,098,764, entitled "Non-woven fabric and method and apparatus for making the same," issued on Mar. 24, 1992; or a foraminous member, such as that disclosed in Trokhan et al., U.S. Pat. No. 5,895,623, entitled "Method of producing apertured fabric using fluid streams," issued on Apr. 20, 1999; each of which is incorporated herein by reference in their entirety.

As used herein, the term "leather materials" refers to materials of natural leather, of reconstituted leather, and/or mixtures thereof, including waste materials generated in each step of the leather production process.

As used herein, "needle punching" means to mechanically entangle a web of either nonbonded or loosely bonded fibers by passing barbed needles through the fiber web. The process of needle punching converts webs of loose fibers into a coherent nonwoven fabric. Needle punching typically is carried out on a needle loom, which refers to a machine for bonding a nonwoven web by mechanically orienting fibers through the web. Barbed needles are set into aboard and "punch" fibers into the batt, i.e., a single or multiple sheets of fiber, and are then withdrawn, thereby leaving the fibers entangled. The needles can be spaced in a non-aligned arrangement. By varying the strokes per minute, the advance rate of the batt, the degree of penetration of the needles, and the weight of the batt, a wide range of fabric densities can be produced.

SUMMARY

The presently disclosed subject matter provides methods for forming artificial leather substrates from waste products of the leather tanning process, e.g., shavings, such as wet blue, and/or pulverized trim scrap.

Accordingly, in some aspects, the presently disclosed subject matter provides a method for forming a nonwoven artificial leather substrate, the method comprising: (a) forming a lightweight web comprising one or more fiber components; (b) forming a composite web by adding leather shavings and/or pulverized leather trim scrap to the lightweight web by one or more of: (i) depositing leather shavings and/or pulverized leather trim scrap onto the lightweight web prior to the crosslapping of step (c); and/or (ii) adding leather shavings and/or pulverized leather trim scrap to the lightweight web during the crosslapping of step (c); (c) crosslapping the composite web to form a crosslapped web; (d) needle punching the crosslapped web to form a nonwoven fabric; (c) crosslapping the nonwoven fabric in preparation for bonding; and (f) bonding the nonwoven fabric by one or more of: (i) hydroentangling; and/or (ii) saturating with a binder, resin, or combinations thereof; to form a nonwoven artificial leather substrate.

In another aspect, the presently disclosed subject matter provides a method for forming a nonwoven artificial leather substrate, the method comprising: (a) mixing one or more fiber components, leather shavings, and/or pulverized leather trim scrap by airlay process or chutefeed system to form a composite of the one or more fiber components, leather shavings, and/or pulverized trim scrap; (b) needle punching the composite of the one or more fiber components, leather shavings, and/or pulverized leather trim scrap to form a nonwoven fabric; and (c) bonding the nonwoven fabric by one or more of: (i) hydroentangling; and/or (ii) saturating with a binder resin, or combinations thereof; to form a nonwoven artificial leather substrate. In certain aspects, the method further comprises depositing the composite of the one or more fiber components, leather shavings, and/or pulverized leather trim scrap onto a substrate prior to the needle punching of step (b).

In certain aspects, the one or more fiber components are selected from the group consisting of a natural fiber component, a synthetic homocomponent or multicomponent fiber component, and mixtures thereof. In particular aspects, the natural fiber component is selected from the group consisting of cotton and wool. In more particular aspects, the synthetic fiber component is selected from the group consisting of a polyester, a polyamide, and rayon. In more particular aspects, the polyester comprises polyethylene terephthalate (PET) or polybutylene terephthalate (PBT).

In certain aspects, the synthetic fiber comprises a bicomponent fiber and the bicomponent fiber may comprise an islands-in-the-sea (INS) fiber structure comprising a sea matrix susceptible to fibrillation.

In other aspects, the one or more fiber components comprise a low-melt binder fiber wherein the low-melt binder fiber may have at least one component that melts at a temperature having a range from about 120° C. to about 180° C.

In certain aspects, the composite web comprises more than one layer comprising one or more fiber components and leather shavings and/or pulverized leather trim scrap. In particular aspects, the composite web has a basis weight ranging from about 500 g/m$^2$ to about 650 g/m$^2$.

In certain aspects, the leather shavings comprise wet blue shavings.

In other aspects, the composite web comprises at least about 50% by weight of leather shavings and/or pulverized leather trim scrap. In more particular aspects, the composite web comprises an amount of leather shavings and/or pulverized leather trim scrap selected from the group consisting of 80% by weight, 75% by weight, 70% by weight, 65% by weight, 60% by weight, 55% by weight, and 50% by weight.

In certain aspects, the method further comprises heating the crosslapped web prior to the needle punching; calendering, the artificial leather substrate; treating the artificial leather substrate with an additive selected from the group consisting of an oil emulsion, a wetting agent, a pigment, a dye, a perfume, a fire retardant, an anti-static agent, an antimicrobial, and combinations thereof.

In other aspects, the method includes further finishing the artificial leather substrate wherein the finishing may comprise a technique selected from the group consisting of embossing, drying, buffing, surface coating, and combinations thereof.

The presently disclosed artificial leather substrates can be used in the automotive industry, the clothing, apparel, and accessory industry, and the upholstery industry.

Certain aspects of the presently disclosed subject matter having been stated hereinabove, which are addressed in whole or in part by the presently disclosed subject matter, other aspects will become evident as the description proceeds when taken in connection with the accompanying Examples and Figures as best described herein below.

BRIEF DESCRIPTION OF THE DRAWINGS

Figure 1:
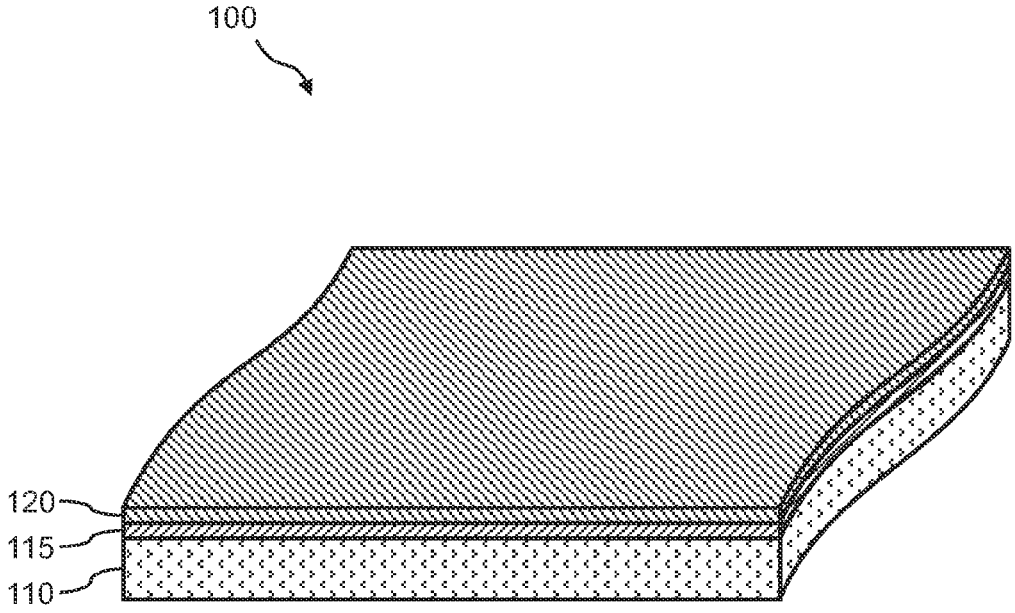
Figure 5:
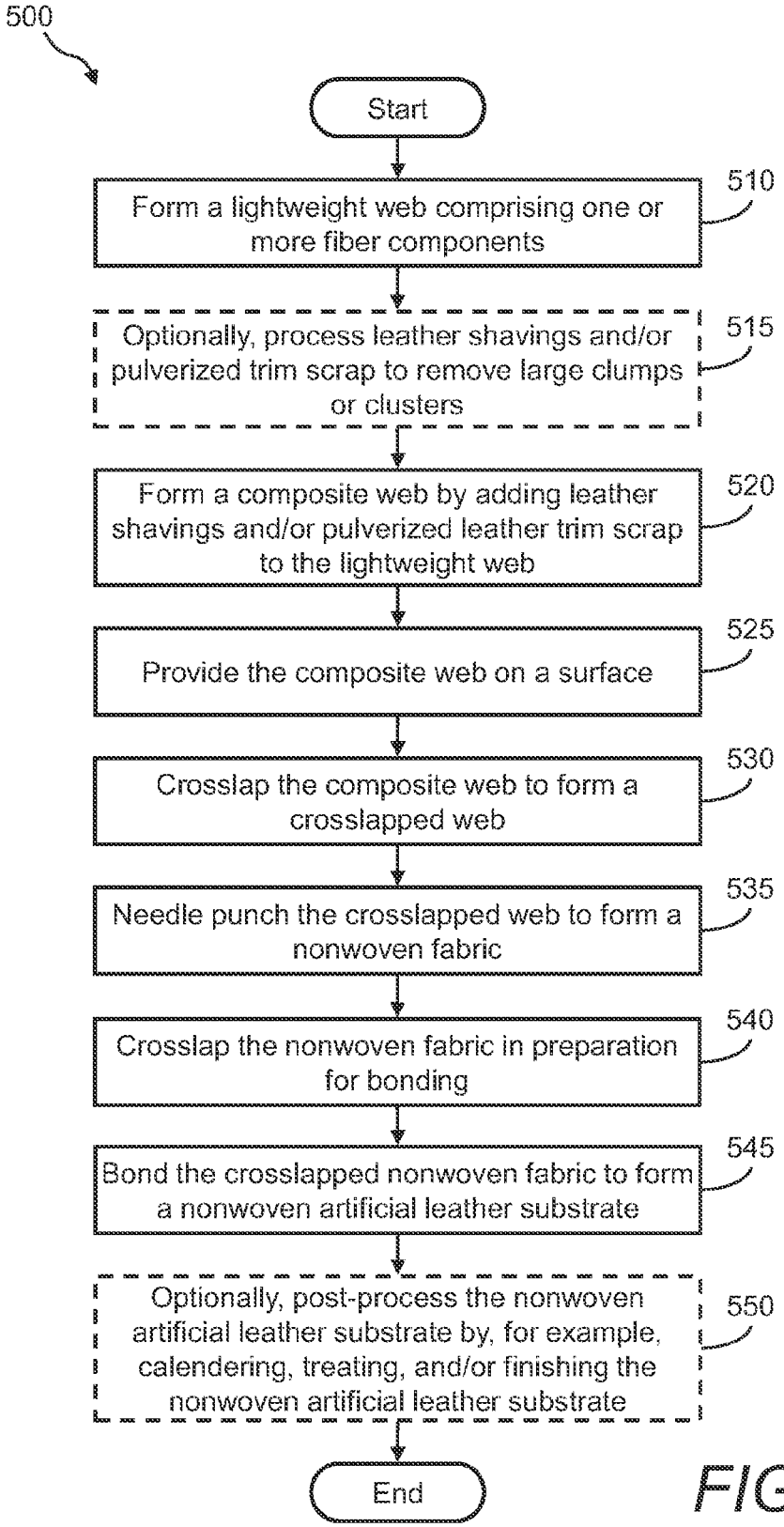
Figure 6:
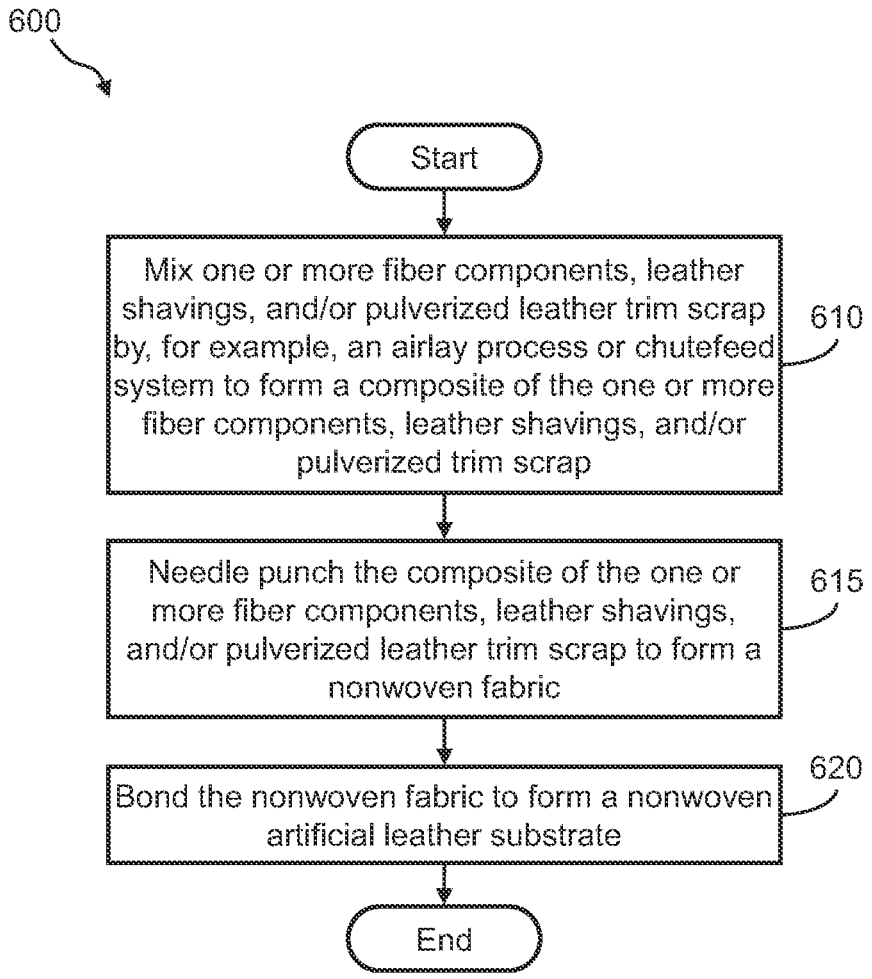

Having thus described the presently disclosed subject matter in general terms, reference will now be made to the accompanying Drawings, which are not necessarily drawn to scale, and wherein:

FIG. 1 illustrates a perspective view of a portion of an example of the presently disclosed artificial leather substrate;

FIG. 2A, FIG. 2B, FIG. 3A, FIG. 3B, FIG. 4A, and FIG. 4B show an example of the process steps of forming the presently disclosed artificial leather substrate and show side views of the artificial leather substrate at each step;

FIG. 5 illustrates a flow diagram of an example of a method of making the presently disclosed artificial leather substrate; and FIG. 6 illustrates a flow diagram of an example of a method of making the presently disclosed artificial leather substrate according to a minimum configuration.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

The presently disclosed subject matter provides methods of making artificial leather substrates from shavings from the leather tanning process and/or from pulverized trim scrap. These waste products can be combined with other fibers to form hybrid compositions of the presently disclosed subject matter. The presently disclosed artificial leather substrates are considered sustainable or environmentally friendly because they use waste products that would otherwise be discarded and added to landfills. The presently disclosed subject matter also provides products formed using the artificial leather substrate.

FIG. 1 illustrates a perspective view of a portion of an example of an artificial leather substrate 100, which is a nonwoven artificial leather substrate. The artificial leather substrate 100 includes a composite web 110. Atop the composite web 110 are one or more lightweight webs that are crosslapped with the composite web 110. In this example, the artificial leather substrate 100 includes two lightweight webs atop the composite web 110. Namely, a lightweight web 115 is atop the composite web 110 and a lightweight web 120 is atop the lightweight web 115.

In some embodiments, the composite web 110 includes a lightweight web component and a leather waste component. Namely, the composite web 110 includes a lightweight web comprising one or more fibers to which a mixture of leather shavings and/or pulverized leather trim scrap is added.

For example, the composite web 110 comprises at least about 50% by weight of leather shavings and/or pulverized leather trim scrap. Accordingly, in some embodiments, the composite web 110 comprises an amount of leather shavings and/or pulverized leather trim scrap selected from the group consisting of 80% by weight, 75% by weight, 70% by weight, 65% by weight, 60% by weight, 55% by weight, and 50% by weight. Generally, the composite web 110 comprises at least about 50% by weight to about 70% by weight leather shavings and/or pulverized leather trim scrap.

The composite web 110 can be formed by adding leather shavings and/or pulverized leather trim scrap to a lightweight web either prior to the crosslapping step or during the crosslapping step.

Chromium is commonly used in tanning processes. Once tanned, the leather has a pale blue color due to the chromium. This product is commonly referred to a "wet blue." In general, however, other forms of leather waste derived from other processes also can be used as well as trims from other artificial leathers When the hide emerges from the wet blue stage, it is shaved until it is smooth and even. This step produces so-called "wet blue shavings."

Accordingly, in particular embodiments, the leather shavings in the composite web 110 comprise wet blue shavings. Wet blue shavings are similar to the consistency of pulp. "Wet blue shavings" and "shavings" are used interchangeably herein. Trim scrap is material that is fully colored and finished, and is a byproduct from leather die cutting operations.

The type of shavings and/or pulverized trim scrap can be taken from any leather tanning process and can be from any animal skin. In some embodiments, the raw material is from bovine waste. One of ordinary skill in the art would recognize that non-bovine sources and shavings, clippings, or off-cuts from other leather production processes are suitable for use with the presently disclosed methods. Generally, any fibers of natural leather, fibers of reconstituted leather, and/or mixtures thereof, are suitable for use with the presently disclosed methods. Accordingly, shavings and/or pulverized trim scrap can originate from any animal skin, including, but not limited to, animal skin from cattle, lamb, deer, elk, pig, buffalo, goat, alligator, snake, ostrich, kangaroo, oxen, and yak. In a particular embodiment, shavings and/or pulverized trim scrap from cattleskin is used for the methods of the presently disclosed subject matter.

In some embodiments, the leather shavings and/or pulverized trim scrap are coarse and the final product made from the shavings and/or trim scrap is too rough to be embossed. In one embodiment, a machine, such as a hammermill, can be used to shred or crush the shavings and/or trim scrap so that the particles are not clumped and are small enough that they not form clusters that would yield a rough surface.

The lightweight web component of the composite web 110 as well as the lightweight web 115 and/or the lightweight web 120 can be formed from a single fiber type or a fiber blend, i.e., a fiber blend comprising a first fiber component, a second fiber component, and so on. One of ordinary skill in the art would appreciate that reference to a first fiber component and a second fiber component does not limit the number of fiber components that can be used to form the composite web 110, the lightweight web 115, and/or the lightweight web 120. For example, when the composite web 110, the lightweight web 115, and/or the lightweight web 120 are formed of a fiber component in addition to the first fiber component, the nonwoven fabric can be formed of two, three, or even more different types of fibers.

In some embodiments, the one or more fiber components of the composite web 110, the lightweight web 115, and/or the lightweight web 120 are selected from the group consisting of a natural fiber component, a synthetic fiber homocomponent or multicomponent component, and mixtures thereof. In certain embodiments, the one or more fiber components comprise a mixture of polyester and cotton. In some embodiments, the synthetic homocomponent fiber comprises polyethylene terephthalate (PET) or polybutylene terephthalate (PBT). Bicomponent or multicomponent fibers may be selected from sheath/core, segmented pie, stripped ribbon, and islands-in-the-sea (INS) varieties.

In particular embodiments, the natural fiber component of the composite web 110, the lightweight web 115, and/or the lightweight web 120 is selected from the group consisting of cotton and wool. One of ordinary skill in the art would recognize that other natural fibers are suitable for use with the presently disclosed methods. Representative examples of natural fibers include, but are not limited to, vegetable fibers, such as cotton, hemp, jute, flax, ramie, sisal, and bagasse; wood fibers such as groundwood, thermomechanical pulp (TMP), bleached or unbleached kraft or sulfite pulps; and animal fibers, such as silkworm silk and wool.

In some embodiments, the synthetic fiber component of the composite web 110, the lightweight web 115, and/or the lightweight web 120 is selected from the group consisting of a polyester, a polyamide, and rayon. In particular embodiments of a synthetic homopolymer, the polyester comprises PET or PBT. One of ordinary skill in the art would recognize that other synthetic fibers, such as rayon, modal, Lyocel, fiberglass, bamboo fiber, and seacell; and synthetic polymer fibers, such as polyamide nylon, PET or PBT polyester, phenol-formaldehyde (PF), polyvinyl alcohol fiber (PVA), polyvinyl chloride fiber (PVC), polyolefins (PP and PE), acrylic polyesters, aromatic polyamides, polyethylene, and polyurethane, are suitable for use with the presently disclosed methods.

In some embodiments, the synthetic fiber comprises a bicomponent fiber. In particular embodiments, the bicomponent fiber comprises an INS fiber structure comprising a sea matrix that lends itself to fibrillation and does not require chemical treatment to remove one component. Such fiber structures are described in Pourdeyhimi et al., U.S. Pat. No. 7,981,226, entitled "High Strength, Durable Micro and Nano-fiber Fabrics Produced by Fibrillating Bicomponent Islands in the Sea Fibers," issued Jul. 19, 2011; and A. Durany, N. Anantharamaiah, and B. Pourdeyhimi, "High Surface Area Nonwovens Via Fibrillating Spunbonded Nonwovens Comprising Islands-In-The Sea Bicomponent Filaments: Structure-Process-Property Relationships," J. Mat. Sci., 44(21): 5926-5934 (2009), each of which is incorporated herein by reference in its entirety.

In some embodiments, the one or more fiber components of the composite web 110, the lightweight web 115, and/or the lightweight web 120 comprise a low-melt binder fiber. In particular embodiments, the low-melt binder fiber has at least one component, for example, one component of a bicomponent fiber, that melts at a temperature having a range from about 120° C. to about 180° C. The low-melt fiber can be a single component fiber or a multicomponent fiber, e.g., a bicomponent fiber.

Representative binder fibers may be homocomponent polyolefin fibers or sheath-core fibers with a lower melting sheath made from a polyester core and a co-polyester sheath. These fibers are commercially available from KoSa, FiberVisons, FIT and others.

In some embodiments, the artificial leather substrate 100 comprises more than one layer comprising one or more fiber components and leather shavings and/or pulverized leather trim scrap. Representative multilayer composites are provided in Example 2. In particular embodiments, the multilayer artificial leather substrate 100 has a basis weight ranging from about 500 g/m$^2$ to about 650 g/m$^2$, including 525 g/m$^2$, 550 g/m$^2$, 575 g/m$^2$, 600 g/m$^2$, 625 g/m$^2$, and 650 g/m$^2$. The "basis weight" refers to a measure of mass of the product per unit area for a particular type of fabric.

In such embodiments, each of the layers of the artificial leather substrate 100 also can be subjected to at least one of needle punching, hydroentangling, resin bonding, and thermal bonding to form additional fiber-to-fiber bonds.

The artificial leather substrate 100 can be formed on any solid flat surface. It is preferable that the shavings and/or pulverized trim scrap are spread relatively evenly across the web or composite.

In another embodiment, the top layer of the artificial leather substrate 100 does not comprise shavings and/or trim scrap, which allows the top layer to remain smooth and suitable for being embossed.

FIG. 2A, FIG. 2B, FIG. 3A, FIG. 3B, FIG. 4A, and FIG. 4B show an example of the process steps of forming the presently disclosed artificial leather substrate 100 and show side views of the artificial leather substrate 100 at each step.

Figure 2A:
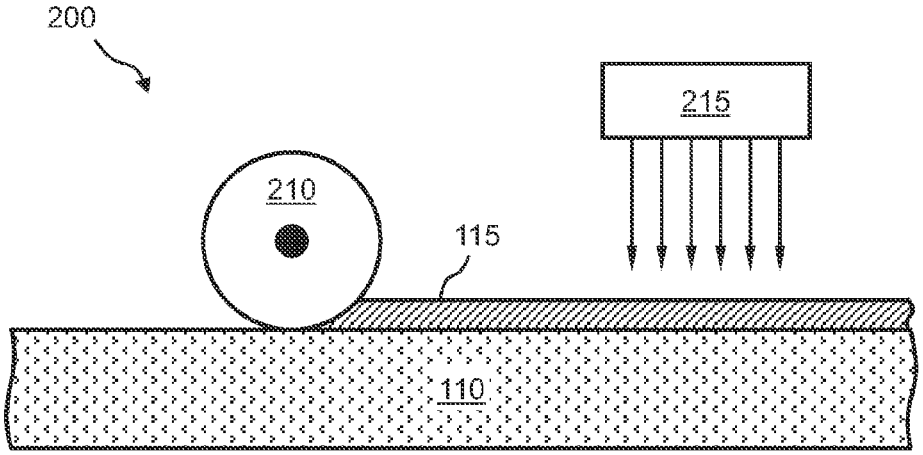
Figure 2B:
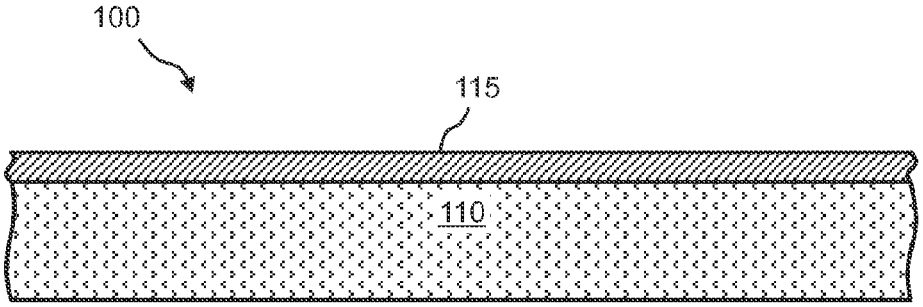

Referring now to FIG. 2A is a crosslapping and needle punching step 200 wherein the composite web 110 is provided on a surface (not shown). Then, an unwinder 210 is used to roll out a layer of the lightweight web 115 atop the composite web 110. Then, the composite web 110 and the lightweight web 115 are needle punched using a needle punch 215, which can be any standard needle punch process. Referring now to FIG. 2B is a side view of the portion of the artificial leather substrate 100 that is formed using the crosslapping and needle punching step 200 of FIG. 2A; namely, the composite web 110 and the lightweight web 115. The lightweight web 120 is not yet formed.

In some embodiments, the crosslapped web is heated prior to the needle punching step. In some embodiments, the crosslapped web is needle punched at least once. The crosslapped web can be pre-needled with one needle board or more than one needle board may be used. In some embodiments, two, three or more needle boards are used. In some embodiments, a total of five boards are used. In other embodiments, three needle boards can be used (pre-needle, one needle board up, one needle board down). A needle board is a board usually covered with short, fine wires that is used for pressing fabrics without crushing the fabric.

Needle punching can be used to better interlock the crosslapped web. Needle punching can improve properties related to, for example, strength, absorption, and resistance to unraveling. In the needle punching process, the fibrous matrix is fed along a feed path into a needle loom. Any needling loom known in the art may be used in the presently disclosed methods, such as, for example, a Fehrer needle loom or a Jaquard needle loom. A needle loom generally includes a reciprocally moving needle carrier for carrying a series of needles arranged in spaced rows or lines along the length of the carrier. The needle carrier is positioned such that when it is reciprocally engaged with the bed of the fibrous matrix structure, the barbs of the needles engage and pull fibers through the body of the fibrous matrix causing the engaged fibers to intertwine among other fibers within the carded and cross-lapped fibrous matrix. Without intending to be bound by theory, the interlocking that occurs causes the finished fabric to become generally more resistant to unraveling.

In representative embodiments, the needle bed of the needle loom can be substantially flat. In other embodiments, the needle bed of the needle loom is curved. In certain embodiments, a curved or an arcuate bed is preferred since it increases the effectiveness of the interlocking that occurs in the fibrous matrix because the needles enter the fibrous matrix structure at varying angles.

The needle punching step can form a nonwoven fabric. As used herein, the term "nonwoven fabric" refers to an assembly of individual fibers or filaments that are interlaid, not necessarily in an identifiable manner, as with knitted or woven fabrics, and that are held together by mechanical interlocking in a random web or mat. The fibers can be oriented in one direction or can be oriented randomly. More particularly, a "nonwoven fabric" is a sheet or web structure bonded together by entangling fibers or filaments mechanically, thermally, or chemically.

Figure 3A:
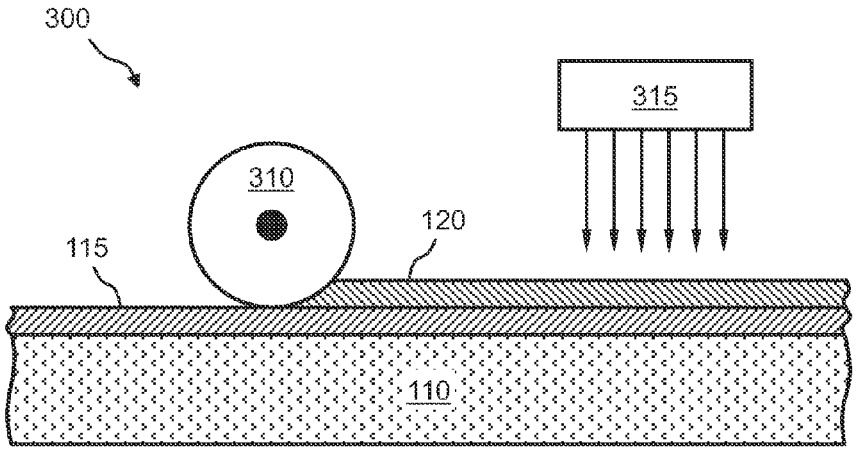
Figure 3B:
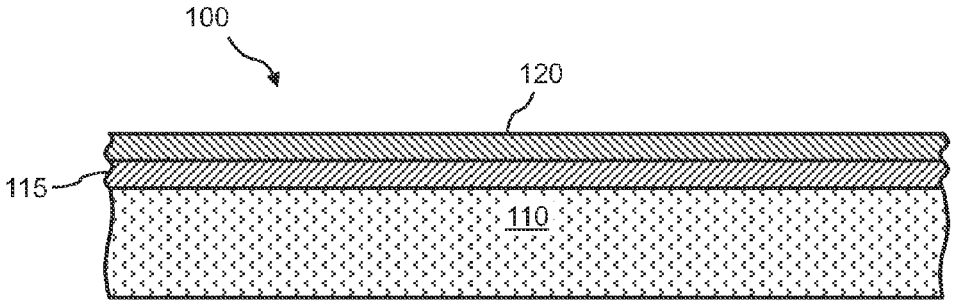

In some embodiments, the artificial leather substrate 100 can be formed by hydroentangling the nonwoven fabric. Referring now to FIG. 3A is a crosslapping and bonding step 300 wherein the composite web 110 and the lightweight web 115 shown in FIG. 2B is provided on a surface (not shown). Then, an unwinder 310 is used to roll out a layer of the lightweight web 120 atop the lightweight web 115. Then, a hydroentangling process 315 is used to bond the lightweight web 120, the lightweight web 115, and the composite web 110. Referring now to FIG. 3B is aside view of the portion of the artificial leather substrate 100 that is formed using the crosslapping and bonding step 300 of FIG. 3A; namely, the composite web 110, the lightweight web 115, and the lightweight web 120.

Nonwoven fabrics conventionally have been produced through hydroentanglement. Improvements have been made to these hydroentanglement processes to improve the properties of the nonwoven fabric with a particular emphasis placed on the durability of the fabric and improved fabric integrity. See, for example, Anantharamaiah, et al., U.S. Pat. No. 8,148,279, entitled "Staple Fiber Durable Nonwoven Fabrics," issued Apr. 3, 2012, which is incorporated herein by reference in its entirety. Hydroentangled nonwoven fabrics are alternatively known in the art as "spunlace fabrics" or "spunlace."

Hydroentanglement further serves to entangle or interlace the fibers of the nonwoven fabric. The fibers of the nonwoven fabric may be interlaced by any hydroentanglement process known in the art. For example, one or more water jets under pressure may be directed at one or both sides of the nonwoven fabric to cause the fibers to become entangled in a repeating pattern of localized entangled regions. The localized entangled regions can in turn become interconnected by fibers extending between adjacent entangled regions.

Hydroentanglement causes the fibers to turn, wind, twist back-and-forth passing about one another in a random, but intricate entanglement, thereby causing the fibers to become interlocked. Regions of fiber entanglement can extend substantially continuously along straight paths or can be distinct entangled masses of other appearances. Patterns having distinct regions of entangled fibers formed within the nonwoven fabric can be controlled by the apertures of the supporting web on which the fibrous structure is carried. Repeating patterns of distinct regions of fiber entanglement can be made to be regular wherein substantially identical arrangements are repeated periodically in at least one direction in the plane of the fabric, or the repeating pattern of distinct regions of fiber entanglement can be made to be irregular.

In another exemplary process, hydroentanglement includes applying a jet of air to the nonwoven fabric to dry, cure, and/or bond the fibers of the nonwoven fabric. While not intending to be limiting, the dwell time, temperature and velocity of the air can be adjusted to achieve the desired degree of entanglement and/or bonding in the nonwoven fabric. An example of such a bonding system includes the rotary and the flatbed THRU-AIR® system. Systems are commercially available from the Honeycomb Division of Metso Paper (Helsinki, Finland).

Figure 4A:
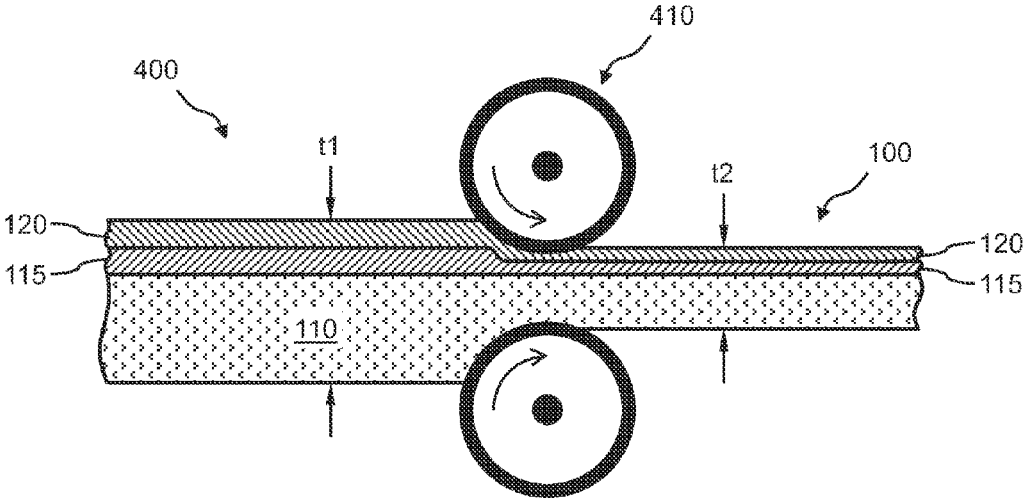
Figure 4B:
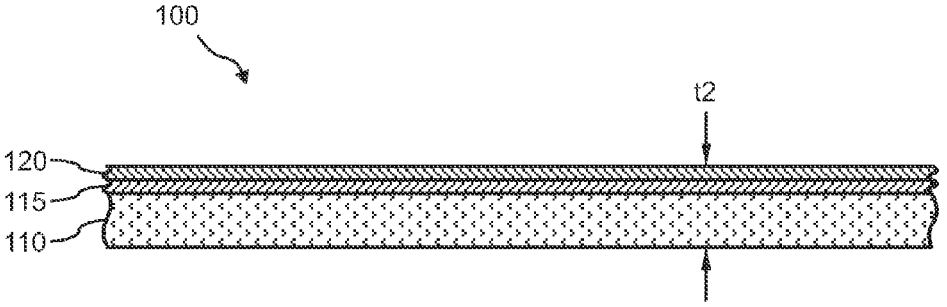

Some consolidation of the artificial leather substrate 100 may occur at the crosslapping and bonding step 300 shown in FIG. 3A. However, FIG. 4A shows a calendering step 400 that is used to further consolidate the artificial leather substrate 100. Namely, the artificial leather substrate 100 shown in FIG. 3B is run between a pair of rollers 410, by which pressure is applied to the structure of the artificial leather substrate 100. FIG. 4B shows the artificial leather substrate 100 after the calendering step 400 has been completed.

Prior to calendering, the artificial leather substrate 100 has a thickness t1. However, after calendering, the artificial leather substrate 100 has a smaller thickness t2, i.e., t1>t2. The thickness t1 can be from about 0.2 mm to about 4 mm in one example, or about 1 mm another example. By contrast, the thickness t2 can be from about 0.5 mm to about 2 mm in one example, or about 3 mm in another example.

More particularly, prior to calendaring, the thickness of the composite web 110 can be from about 0.2 mm to about 5 mm in one example, or about 3 mm in another example. However, after calendaring, the thickness of the composite web 110 can be from about 0.1 to about 0.25 mm in one example, or about 1.5 mm in another example. Further, prior to calendaring, the thickness of each of the lightweight webs 115, 120 can be from about 5 microns to about 200 microns in one example, or about 100 microns in another example. However, after calendaring, the thickness of each of the lightweight webs 115, 120 can be from about 4 microns to about 150 microns in one example, or about 80 microns in another example.

More details of examples of methods of forming the artificial leather substrate 100 are shown and described herein below with reference to FIG. 5 and FIG. 6.

FIG. 5 illustrates a flow diagram of an example of a method 500 of making the presently disclosed artificial leather substrate 100. The method 500 includes, but is not limited to, the following steps.

At a step 510, a lightweight web is formed comprising one or more fiber components, wherein the lightweight web is one component of the composite web 110 that is shown and described in FIG. 1. As described in FIG. 1, the lightweight web component of the composite web 110 can be formed from a single fiber type or a fiber blend, i.e., a fiber blend comprising a first fiber component, a second fiber component, and so on.

At an optional step 515, the leather shavings and/or pulverized trim scrap are processed so that particles are not clumped or clustered together. Sometimes the leather shavings and/or pulverized trim scrap are coarse and the final product made from the shavings and/or trim scrap is too rough to be embossed. In one example, a machine, such as a hammermill, can be used to shred or crush the shavings and/or trim scrap so that the particles are not clumped and are small enough that they will not form clusters that would yield a rough surface.

At a step 520, a composite web is formed by adding leather shavings and/or pulverized leather trim scrap to the lightweight web formed in the step 520. For example, the composite web 110 is formed by adding leather shavings and/or pulverized leather trim scrap to the lightweight web component thereof as described. in FIG. 1. Namely, the composite web 110 includes the lightweight web comprising one or more fibers to which a mixture of leather shavings and/or pulverized leather trim scrap is added. It is preferable that the leather shavings and/or pulverized trim scrap are spread relatively evenly across the lightweight web.

For example and as described in FIG. 1, the composite web 110 comprises at least about 50% by weight of leather shavings and/or pulverized leather trim scrap. Accordingly, in some embodiments, the composite web 110 comprises an amount of leather shavings and/or pulverized leather trim scrap selected from the group consisting of 80% by weight, 75% by weight, 70% by weight, 65% by weight, 60% by weight, 55% by weight, and 50% by weight. Generally, the composite web 110 comprises at least about 50% by weight to about 70% by weight leather shavings and/or pulverized leather trim scrap.

At a step 525, the composite web is provided on a surface. For example, the composite web 110 of FIG. 1 is provided on a surface. The composite web 110 can be formed on any flat surface that is solid enough to hold the composite web 110 and the artificial leather substrate 100 after it is formed.

At a step 530, the composite web is crosslapped to forma crosslapped web. For example and referring again to FIG. 2A, the composite web 110 is crosslapped with the lightweight web 115 to form a crosslapped web.

At a step 535, the crosslapped web is needle punched to form a nonwoven fabric. For example and referring again to FIG. 2A, the composite web 110 and the lightweight web 115 are needle punched using needle punch 215 to form a nonwoven fabric.

At a step 540, the nonwoven fabric is crosslapped in preparation for bonding. For example and referring again to FIG. 3A, the composite web 110 and the lightweight web 115, which is a nonwoven fabric, is crosslapped with the lightweight web 120 in preparation for bonding.

At a step 545, the crosslapped nonwoven fabric is bonded to form a nonwoven artificial leather substrate. For example and referring again to FIG. 3A, the nonwoven fabric comprising the composite web 110, the lightweight web 115, and the lightweight web 120 is bonded to form the nonwoven artificial leather substrate 100. In one example, the nonwoven fabric comprising the composite web 110, the lightweight web 115, and the lightweight web 120 is bonded by the hydroentangling process, as described with reference to FIG. 1.

In another example, the nonwoven fabric comprising the composite web 110, the lightweight web 115, and the lightweight web 120 is bonded by saturating the nonwoven fabric with a binder or resin. In some embodiments, binder fibers and/or resins may be used to bind to the material after needle punching the material. The use of binders and/or resins allows the consolidation of the web and shavings, a reduction in thickness, and/or more flexibility in terms of bending of the substrate. As used herein, the term "binder" refers to a material, e.g., an adhesive material or meltable material, used to bond fibers together in a web or to bind one web to another.

In some embodiments, the nonwoven fabric is bonded through a resin bonding technique wherein a sufficient amount of resin is added to the interlaced fibrous structure to achieve a desired strength in the fabric. Non-limiting examples of resins include acrylics, polyurethanes, latexes, and any combination thereof. In some embodiments, the resin is impregnated in the nonwoven fabric. In other embodiments, the resin is applied by passing the nonwoven fabric through a bath of the resin. In yet other embodiments, the nonwoven fabric is sprayed with the resin. Indeed, any process known in the art for applying resins may be used in the presently disclosed subject matter.

In certain embodiments, the resin is heated and cured to enhance the strength and the durability of the structure. Preferably, the amount of heat during curing will be sufficient to partially melt a secondary fiber and/or fiber component that have been included in the structure to cause additional bonding to occur within the fibrous structure.

In certain embodiments, the functional groups of the resin, such as, for example, amine groups, epoxy groups, or any combination thereof, are selected to promote the type of bonding that is desired to be achieved in the nonwoven fabric. For example, in one embodiment, the functional groups of the resin are selected to promote bonding within the resin itself. In other embodiments, the functional groups of the resin are selected to promote bonding with one or more of the types of fibers included in the nonwoven fabric. In yet other embodiments, the functional groups of the resin are selected to promote, bonding both within the resin itself and with one or more of the types of fibers included in the nonwoven fabric.

In some embodiments, the concentration of resin bonding agent included in the nonwoven fabric is less than about 15% by weight of the total weight of the nonwoven fabric. In certain embodiments, the concentration of resin bonding agent included in the nonwoven fabric is less than about 10% by weight of the total weight of the nonwoven fabric. In other embodiments of the invention, the concentration of bonding agent included in the nonwoven fabric is less than about 9%, about 8%, about 7%, about 6%, about 5%, about 4%, about 3%, about 2.5%, about 2%, about 1.5%, about 1%, or about 0.5% by weight of the total weight of the nonwoven fabric. In certain embodiments of the invention, the amount of resin applied to the interlaced fibrous structure is chosen based on the durability desired for the finished fabric.

In particular embodiments, the resin will have at least one of an acrylic or polyurethane. In some embodiment, the acrylic or polyurethane may have a concentration from about 1% to about 15% by weight based on the total weight of the nonwoven fabric. In other embodiments, the resin having at least one of an acrylic or polyurethane may have a concentration from about 3% to about 5% by weight based on the total weight of the nonwoven fabric.

In yet other embodiments, the bonding process can be through adhesive bonding, a form of resin bonding. The adhesive may be applied to the nonwoven fabric by, for example, slot coating, spray coating, or any other topical application. In yet another embodiment, pressure sensitive adhesives can be added as part of the crosslapped web. As pressure is applied at various points throughout the process, the fibers that become contacted will become bonded. Optionally, pressure may be applied to the nonwoven fabric in for example, a final step, by passing the unfinished fabric through at least one lap roller and pressure roller combination or even through a set of nip rolls to secure other fibers with the pressure sensitive adhesive. When an adhesive is used, preferably it is included in the concentrations described above for resins.

In yet another example, the nonwoven fabric comprising the composite web 110, the lightweight web 115, and the lightweight web 120 is bonded by the combination of both hydroentangling and saturating with a binder or resin.

At an optional step 550, the nonwoven artificial leather substrate 100 can be post-processed by, for example, calendering, treating, and/or finishing the nonwoven artificial leather substrate 100. In one example of a post-processing operation, an image, pattern, or other surface effect may be imparted to the nonwoven fabric. Techniques for imparting an image, pattern, or surface effect to the nonwoven fabric include hydroentanglement processes, as already described herein, and calendering. Indeed, any process known in the art for imparting an image, pattern, or surface effect to a web may be used with the presently disclosed subject matter.

While images, patterns, or other surface effects can be used for aesthetic purposes, such processing techniques also can be used to influence other properties of the nonwoven fabric. In another example of a post-processing operation, calendering the nonwoven may help to smooth the surface of the finished fabric. Calendering also can be useful in achieving a desired thickness of the nonwoven fabric when thickness is important for a particular application. As would be understood by one or ordinary skill in the art, when the thickness of a formed nonwoven fabric is reduced by a calendering process, the density of the fabric increases. While helping to achieve a certain thickness, calendering also can be useful for eliminating variations in thickness of the nonwoven fabric.

Various operational factors can influence the effect of calendering on a nonwoven web. Such factors can be optimized to achieve a desired effect. Without intending to be limiting, the following factors can influence the image, pattern, or other surface effects imparted to the nonwoven web through calendering: number of nips, temperature of the rolls, pressure at the nip, uniformity of temperature and pressure of the nip rollers, processing line speed, types of fibers used in forming the nonwoven fabric, materials of the fibers used in forming the nonwoven fabric, thickness of the nonwoven web, and any combination thereof.

Further, the mesh of the belt may be chosen not only to provide a desired texture to the inventive nonwoven fabric, but also to affect the desired properties of the inventive nonwoven fabric. As used herein, the term "mesh count" refers to the number of opening per lineal inch of a mesh screen. The openings are delineated by strands, typically plastic threads or wires, in the mesh screen. Optionally, the mesh count may be selected to be substantially the same or different in the longitudinal or machine direction (MD) and the transverse or cross machine direction (CD). Non-limiting examples of properties of a nonwoven fabric that can be affected by patterning imparted by, for example, a belt mesh include grab tensile strength, tongue tear strength, and any combination thereof in at least one direction MD and CD of the nonwoven fabric. In some embodiments, the mesh size is less than about 100 mesh, less than about 50 mesh, less than about 40 mesh, less than about 30 mesh, less than about 25 mesh, and less than about 20 mesh. In yet another representative embodiment, the mesh is a herringbone mesh screen. In another embodiment, the diameters of the strands of the mesh screen are selected to achieve a preferred property of the nonwoven fabric.

The calendering step can further thermally stabilize the substrate through thermally bonding. In yet other embodiments, thermal treatment of the substrate can be accomplished by induction with high-energy waves or by exchange with heated air. Indeed any thermal stabilization technique known in the art may be used to thermally stabilize or bond the fibers of the presently disclosed substrates.

In yet another example of a post-processing operation, after formation of the artificial leather substrate, the substrate can be treated, for example, in some embodiments, impregnated, with oil emulsions, wetting agents, pigments, perfumes, fire retardants, anti-static agents, antimicrobials, and other additives known in the art to improve the handleability and durability of the final product. The additives can be included in the fibers or fiber blends or can be disposed substantially at the surface of the fibers.

Such treatments are well known in conventional leather-making practice and can be followed by finishing techniques, including, but not limited to, embossing, drying, buffing, and surface coating to provide a leather-like final finish. In further embodiments, the substrate formed by the presently disclosed methods can be softened by using tumbling techniques or chemical softeners, for example.

FIG. 6 illustrates a flow diagram of an example of a method 600 of making the presently disclosed, artificial leather substrate 100 according to a minimum configuration. The method 600 includes, but is not limited to, the following steps.

At a step 610, the one or more fiber components, leather shavings, and/or pulverized leather trim scrap are mixed using, for example, an airlay process or chutefeed system to form the composite web 110 of the artificial leather substrate 100, which is a mixture of one or more fiber components, leather shavings, and/or pulverized trim scrap.

At a step 615, the composite web 110 of the one or more fiber components, leather shavings, and/or pulverized leather trim scrap is needle punched to form a nonwoven fabric. For example, the composite web 110 and the lightweight web 115 are needle punched to form a nonwoven fabric, as shown and described in FIGS. 2A and 2B.

At a step 620, the nonwoven fabric is bonded to form the nonwoven artificial leather substrate 110. For example, the nonwoven fabric comprising the composite web 110, the lightweight web 115, and the lightweight web 120 is bonded to form the nonwoven artificial leather substrate 110, as shown and described in FIGS. 3A and 3B. Namely, the nonwoven fabric can be bonded by hydroentangling, by saturating with a binder or resin, or by the combination of both hydroentangling and saturating with a binder or resin.

Preferably, the artificial leather substrate 100 as described in FIG. 1 through FIG. 6 can be finished to have the look and feel of real leather and have many physical properties and characteristics, including strength and pliability, of natural, unreconstituted or unrecycled leather. Accordingly, the final product produced by the presently disclosed methods can be cut and sewn into leather-like products.

Preferably, the artificial leather substrate 100 has one or more of the following characteristics; surface uniformity and smoothness, which is necessary for embossing the final grain on the substrate; bending rigidity, in which the final product must be flexible enough to mimic natural leather products or currently available synthetic leather products; and density of at least 40% or higher and control of surface hydrophobicity, which is necessary to maintain a balance between a coating and the coating penetrating the substrate. As a result of the presently disclosed methods, the substrate is compact and dense and its surface is smooth and suitable for finishing into a final product.

The products of the presently disclosed methods can be characterized by one or more of the following tests or parameters including, but not limited to, thickness, basis weight, tensile, tear and bending machine direction (MD), and cross direction (CD), and bursting and fatigue testings, e.g., measured with TruBurst testing equipment (Jame Heal, Halifax, UK).

Leather products made by the presently disclosed methods are woven in appearance, and can be cut, sewn and shaped into products commonly formed of natural leather and/or synthetic leather materials including, but not limited to, insoles, mid soles and linings for shoes, boots, skates and other types of footwear; leather-like pads, liners, panels, supports or outside finishes for use in the apparel, furniture, packaging, automobile, computer, and other industries. In particular embodiments, the final substrate can be used to form artificial leather or suede for the automotive industry, the clothing, apparel and accessory industries, or the upholstery industry.

Accordingly, the artificial leather substrate 100, which is a nonwoven fabric, can be used in a wide variety of ways. In some embodiments, the substrate is used to form a coated fabric. As used herein, the term "coated fabrics" refers to a layer of a material or a laminate that is added to the substrate as a subsequent finishing step. In some embodiments, the coating material is similar to the material used to make the final substrate and in other embodiments, the material is different. The final product formed from the presently disclosed methods may be coated with a synthetic material, such as polyvinyl chloride (PVC), to give the substrate increased strength, durability, and/or environmental resistance.

EXAMPLES

The following Examples have been included to provide guidance to one of ordinary skill in the art for practicing representative embodiments of the presently disclosed subject matter. In light of the present disclosure and the general level of skill in the art, those of skill can appreciate that the following Examples are intended to be exemplary only and that numerous changes, modifications, and alterations can be employed without departing from the scope of the presently disclosed subject matter. The synthetic descriptions and specific examples that follow are only intended for the purposes of illustration, and are not to be construed as limiting in any manner to make compounds of the disclosure by other methods.

Example 1

One Embodiment of the Methods Used in Forming an Artificial Leather Substrate This Example discloses one specific embodiment of the presently disclosed subject matter. The method is performed generally as shown and described in FIG. 1 through FIG. 6. Several different percentages of PET to sheath-core binder fiber with a Co-PET sheath and PET core hereafter referred to as Co-PET binder are used to determine an optimal percentage.

The particle dispenser is mounted on the carding unit. The following webs are made and wet blue shavings are dispersed in the web to form a composite:

100% PET 1.5 denier/Wet Blue shavings

75% PET 1.5 denier/25% Co-PET Binder/Wet Blue shavings

50% PET 1.5 denier/50% Co-PET Binder/Wet Blue shavings

For the needle punching step, three needle boards can be used (pre-needle, one needle board up, one needle board down).

A hydroentangling step is performed on a unit that comprises five manifolds or injectors, each of which has holds a jet strip with one or more rows of nozzles spaced apart about 500 microns or more. Three of the manifolds impact the surface of the web, while the last two impact the back surface. The pressure in each manifold is controlled individually. In one embodiment, the pressures were set at 30, 120, 120, 0, 0 bar respectively; a pressure of zero indicates that the injectors were off and did not impact the web. The jet strips used had a capillary of 120 microns. The last jet strip used was a double now strip with two different sizes for the capillaries to "finish" and smooth the surface according to Pourdeyhimi, et al., U.S. Pat. No. 7,467,446, entitled "System and Method for Reducing Jet Streaks in Hydroentangled Fibers," issued Dec. 23, 2008, which is incorporated herein by reference in its entirety.

The process can be completed with a tissue layer placed on top of the crosslapped web before hydroentangling. Alternatively, a splittable mixed media produced according to Pourdeyhimi, et al., U.S. Pat. No. 7,981,336, entitled "Process for Making Mixed Fibers and Nonwovens," issued Jul. 19, 2011, which is incorporated herein by reference in its entirety, can be placed on top before hydroentangling.

Calendering is used to reduce the total thickness and to met and bind the binder fibers to the leather content and to the fibers.

Example 2

Representative Multilayer Composite

In particular embodiments, the web comprises 35 g/m$^2$ spunbond INS with PET and polyethylene (PE) or PA6 (also referred to as nylon 6, polycaprolactam, or polyamide 6). In other embodiments, the web comprises 35 g/m$^2$ cotton. These webs can be used to form a multilayer composite, including representative composite structures having the following compositions:

2 layers of 35 g INS/360 g leather trimmings/2 layers of 35 g INS=500 g/m$^2$;

2 layers of 35 g INS/360 g leather trimmings/2 layers of 35 g cotton=500 g/m$^2$;

2 layers of 35 g cotton/360 g leather trimmings/2 layers of 35 g cotton=500 g/m$^2$;

4 layers of 35 g INS/360 g leather trimmings/4 layers of 35 g INS=640 g/m$^2$;

4 layers of 35 g INS/360 g leather trimmings/4 layers of 35 g INS=640 g/m$^2$;

4 layers of 35 g cotton/360 g leather trimmings/4 layers of 35 g cotton=640 g/m$^2$;

4 layers of 35 g INS/360 g leather trimmings/2 layers of 35 g INS=570 g/m$^2$;

4 layers of 35 g INS/360 g leather trimmings/2 layers of 35 g cotton=570 g/m$^2$; and 2 layers of 35 g INS/360 g leather trimmings/2 layers of 35 g cotton=570 g/m$^2$.

The multilayer composites can be bonded by hydroentangling and can be characterized by one or more of the following tests or parameters including, but not limited to, thickness, basis weight, tensile, tear and bending (machine direction (MD), and cross direction (CD), and bursting and fatigue testings, e.g., measured with TruBurst testing equipment (Jame Heal, Halifax, UK).

Although specific terms are employed herein, they are used in a generic and descriptive sense only and not for purposes of limitation. Unless otherwise defined, all technical and scientific terms used herein have the same meaning as commonly understood by one of ordinary skill in the art to which this presently described subject matter belongs.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments 20%, in some embodiments 10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

REFERENCES

All publications, patent applications, patents, and other references mentioned in the specification are indicative of the level of those skilled in the art to which the presently disclosed subject matter pertains. All publications, patent applications, patents, and other references are herein incorporated by reference to the same extent as if each individual publication, patent application, patent, and other reference was specifically and individually indicated to be incorporated by reference. It will be understood that, although a number of patent applications, patents, and other references are referred to herein, such reference does not constitute an admission that any of these documents forms part of the common general knowledge in the art.

Pourdeyhimi et al., U.S. Pat. No. 7,438,777, entitled "Lightweight High-Tensile, High-Tear Strength Bicomponent Nonwoven Fabrics," issued Oct. 21, 2008, Pourdeyhimi et al., U.S. Pat. No. 7,935,645, entitled "Lightweight High-Tensile, High-Tear Strength Bicomponent Nonwoven Fabrics," issued May 3, 2011.

N. Fedorova and B. Pourdeyhimi, "High Strength, Light Weight Nonwovens via Spunbonding," J. Appl. Sci., 104(5):3434-3442 (2007);

Pourdeyhimi, et al., U.S. Patent Pub. No. 20110318986, entitled "Micro and Nanofiber Nonwoven Spunbonded Fabric," published Dec. 29, 2011;

Pourdeyhimi et al., U.S. Pat. No. 7,981,226, entitled "High Strength, Durable Micro and Nano-fiber Fabrics Produced by Fibrillating Bicomponent Islands in the Sea Fibers," issued Jul. 19, 2011;

A. Durany, N. Anantharamaiah, and B. Pourdeyhimi, "High Surface Area Nonwovens Via Fibrillating Spunbonded Nonwovens Comprising Islands-In-The Sea Bicomponent Filaments: Structure-Process-Property Relationships," J. Mat. Sci., 44(21): 5926-5934 (2009);

Bevan, U.S. Pat. No. 8,225,469, entitled "Formation of Sheet Material Using Hydroentanglement," issued Jul. 24, 2012;

Bevan, U.S. Pat. No. 7,731,814, entitled. "Formation of Leather Sheet Material Using Hydroentanglement," issued Jun. 8, 2010;

Addie et al., U.S. Pat. No. 6,264,879, entitled "Reconstituted Leather Product and Process," issued Jul. 24, 2011;

Pourdeyhimi, et al., U.S. Pat. No. 7,467,446, entitled "System and Method for Reducing Jet Streaks in Hydroentangled Fibers," issued Dec. 23, 2008; and Pourdeyhimi, et al., U.S. Pat. No. 7,981,336, entitled "Process for Making Mixed Fibers and Nonwovens," issued Jul. 19, 2011.

That which is claimed:

1. A method for forming a nonwoven artificial leather substrate, the method comprising:

(a) forming a lightweight web comprising one or more fiber components;

(b) forming a composite web by adding leather shavings and/or pulverized leather trim scrap to the lightweight web by one or more of:

(i) depositing leather shavings and/or pulverized leather trim scrap onto the lightweight web prior to the crosslapping of step (c); and/or (ii) adding leather shavings and/or pulverized leather trim scrap to the lightweight web during the crosslapping of step (c);

(c) crosslapping the composite web to form a crosslapped web;

(d) needle punching the crosslapped web to form a nonwoven fabric;

(e) crosslapping the nonwoven fabric in preparation for bonding; and (f) bonding the nonwoven fabric by one or more of:

(i) hydroentangling; and/or (ii) saturating with a binder, resin, or combinations thereof;

to form a nonwoven artificial leather substrate.

2. The method of claim 1, wherein the one or more fiber components are selected from the group consisting of a natural fiber component, a synthetic homo-component or synthetic multicomponent fiber component, and mixtures thereof.

3. The method of claim 2, wherein the one or more fiber components are a natural fiber component selected from the group consisting of cotton and wool.

4. The method of claim 2, wherein the one or more fiber components are a synthetic fiber component selected from the group consisting of a polyester, a polyamide, and rayon.

5. The method of claim 2, wherein the one or more fiber components are a synthetic fiber component which comprises a bicomponent fiber.

6. The method of claim 1, wherein the one or more fiber components comprise a low-melt binder fiber.

7. The method of claim 6, wherein the low-melt binder fiber has at least one component that melts at a temperature having a range from about 120° C. to about 180° C.

8. The method of claim 1, wherein the composite web comprises more than one layer comprising one or more fiber components and leather shavings and/or pulverized leather trim scrap.

9. The method of claim 1, wherein the composite web has a basis weight ranging from about 500 $g/m^2$ to about 650 $g/m^2$.

10. The method of claim 1, wherein the leather shavings comprise wet blue shavings.

11. The method of claim 1, wherein the composite web comprises at least about 50% by weight of leather shavings and/or pulverized leather trim scrap.

12. The method of claim 1, further comprising heating the crosslapped web prior to the needle punching of step (d).

13. The method of claim 1, further comprising calendering the artificial leather substrate.

14. The method of claim 1, further comprising treating the artificial leather substrate with an additive selected from the group consisting of an oil emulsion, a wetting agent, a pigment, a dye, a perfume, a fire retardant, an anti-static agent, an antimicrobial, and combinations thereof.

15. The method of claim 1, further finishing the artificial leather substrate.

16. The method of claim 15, wherein the finishing comprises a technique selected from the group consisting of embossing, drying, buffing, surface coating, and combinations thereof.

* * * * *